US005083518A

United States Patent [19]

Ciucani

[11] Patent Number: 5,083,518

[45] Date of Patent: Jan. 28, 1992

[54] MACHINE FOR MAKING FOOTWEAR

[76] Inventor: Mario Ciucani, via S. Girolamo, Fermo (AP), Italy

[21] Appl. No.: 547,497

[22] Filed: Jul. 2, 1990

[30] Foreign Application Priority Data

Jul. 10, 1989 [IT] Italy ..... 3547 A/89

[51] Int. Cl.[5] ..... D05B 15/02

[52] U.S. Cl. ..... 112/62; 112/49; 112/35

[58] Field of Search ..... 112/28, 35, 37, 49, 112/62, 260

[56] References Cited

U.S. PATENT DOCUMENTS

| | | | |
|---|---|---|---|
| 1,177,972 | 4/1916 | Stromdahl | 112/62 |
| 1,672,707 | 6/1928 | Burrier | 112/62 |
| 1,786,624 | 12/1930 | Leveque | 112/62 |
| 2,354,468 | 7/1944 | Like | 112/62 |
| 2,383,529 | 8/1945 | Ashworth | 112/62 |
| 2,387,813 | 10/1945 | Speight | 112/62 |

*Primary Examiner*—Werner H. Schroeder
*Assistant Examiner*—Ismael Izaguirre
*Attorney, Agent, or Firm*—Darby & Darby

[57] ABSTRACT

A machine for manufacturing shoes by stitching along the border of the shoe with a striker situated inside the upper and positioned in the stitching area of the shoe, comprises a freely rotatable striker supported by an oscillating arm and positioned on the inside of the upper in correspondence of a stitching station. The station is defined by a guide fork situated with its prongs in a horizontal position, with which the striker engages when in its operating position.

12 Claims, 5 Drawing Sheets

100
C
12
38
14
13
16
17
28
35
S
T
V
L
D
2b
1
4b
3b
3a
J1
J2
4a
2a

100
C
12
11
30
8
A
10
31
21
9
15
18
19

MACHINE FOR MAKING FOOTWEAR

BACKGROUND OF THE INVENTION

This invention concerns machines and tools for making footwear.

To be more precise, the invention described below, concerns in particular a method and a machine for carrying out the final stitching between the upper/ready made sole assembly and the sole of a shoe produced in accordance with a known process.

DESCRIPTION OF THE PRIOR ART

It is well-known that to make footwear, for example the type commonly called "moccasin", there is an initial temporary joining by means of gluing or a temporary stitching, between an external part, called the upper, and a ready-made sole, after which the final joining takes place by means of thick stitching all along the perimeter of the sole.

Finally the part of the shoe called the vamp, and other parts which complete and embellish the shoe are stitched to the upper.

A known machine is capable of carrying out the final stitching by means of suitable devices which move a pair of opposite facing needles which operate in correspondence with a guide fork facing the operator and situated in such a manner that its parallel prongs are in a horizontal position.

On the prongs there are slots through which the needles pass following a circular trajectory in a vertical plane.

The edges of the upper, with the ready-made sole and the sole fixed to it, are inserted into the space between the two prongs. The length of the stitch is determined by the horizontal movement of the group of needles, which can take place owing to the slots on the prongs, while the skill of the operator alone must ensure that the correct line of stitching is maintained.

In one particular model of moccasin, this stitching is carried out along the edge of the upper joined to the ready-made sole thus forming a border which projects horizontally outwards, around the whole perimeter of the sole.

The first step for making this sort of shoe is to put the upper on a last and join the ready-made sole to the upper, with the aid of the said last.

The joining, as already stated may be obtained by gluing or with a temporary stitching.

At this point, using the machine described above, the final stitching between the upper/ready made sole assembly and the sole is carried out.

The stitching can be guided manually, after having extracted the last, if the stitching to be carried out does not affect the whole edge of the sole in a continuous way but rather is in successive separate tracts, as for example in footwear of the sandal type.

To do the job in the best manner possible, it is however necessary to provide the shoe with an internal striker situated in the working area of the needles.

With this aim the top of an arm, of a suitable shape and fixed to the machine, is inserted inside the shoe, between the parts to be stitched.

This is made possible by the particular structure of open-type shoes which permits the arm to be inserted from different positions.

When the shoe is of the closed type and the stitching must be continuous along the whole perimeter of the sole, then use of the arm is not possible, because it would prevent rotation of the shoe, and the operation must be carried out with the last still inside the upper.

On the other hand, while inserting the last in the upper allows the best possible stitching to be obtained, it calls however for very wide unattractive borders along the perimeter of the sole.

This is a consequence of the fact that the last cannot be inserted between the prongs of the machine and neither can it be shaped in such a way as to be inserted between the upper and the ready-made sole where the latter are joined, since it must afterwards be extracted from the upper.

So the last tends to move the border of the upper, folded onto the sole and the border of the sole away from the working area of the needles.

As a consequence, as already stated, the borders around the perimeter of the sole and the upper are wide.

Another drawback is the slowness of operations due to use of the last, which does not simplify stitching operations.

SUMMARY OF THE INVENTION

The object of the invention is to use a method for making footwear, as described above, which allows greater speed of operations and with narrower borders on the sole and the upper.

A further object of the invention is to provide a machine of the type mentioned above and improved in such a way as to permit the proposed method to be implemented.

The afore-mentioned objects are achieved by means of a method for manufacturing footwear of a type having an upper to the underside of which is joined a ready-made sole, making up an upper/ready-made sole assembly joined by stitching to a sole, with the stitching being carried out along the entire perimeter of the sole.

The method comprises the following steps: obtaining an upper, a ready-made sole and a sole, the latter having an external and continuous border; joining the upper and the ready made sole, with the aid of a last inserted into the upper; extraction of the last inserted into the said upper; temporary joining of the assembly to the sole being obtained by joining the ready-made sole to the sole; final stitching between the upper/ready-made sole assembly and the sole, along the border of the sole, with a striker located within the upper and designed to remain positioned in the stitching area of the shoe even during the rotational and translational motion of the latter.

The machine for carrying out this method comprises: a stitching station made up of a guide fork having its open end facing the operator of the machine and oriented so that its lower and upper parallel prongs are in a horizontal position; two slots in the two prongs designed to allow the passage of upper and lower curved opposite-facing needles, operating in the station, and driven by the machine in a semi-circular trajectory and with horizontal movements in opposite directions in order to affect the stitching; a striker which slides along the inside part of the upper/ready-made sole assembly at the station and that is supported by support means which oscillate upwards and downwards to and from a working position, in which the striker is positioned against the guide fork, with the shoe between them, and an idle position in which the striker is not in contact with the fork, with the means being oscillating in opposite directions, in a horizontal plane to permit the shoe to be rotated during the stitching.

BRIEF DESCRIPTION OF THE DRAWINGS

The present invention can be more fully understood by reference to the following description and accompanying drawings which form an integral part of this application and in which.

DESCRIPTION OF THE PREFERRED EMBODIMENT

Figure 2:
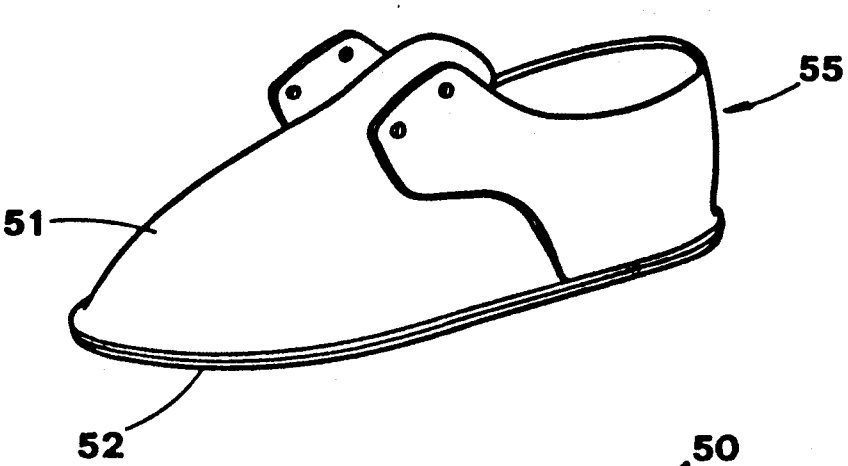
FIG. 2 and 3 show an intermediate stage of the method and the completed shoe.
Figure 3:
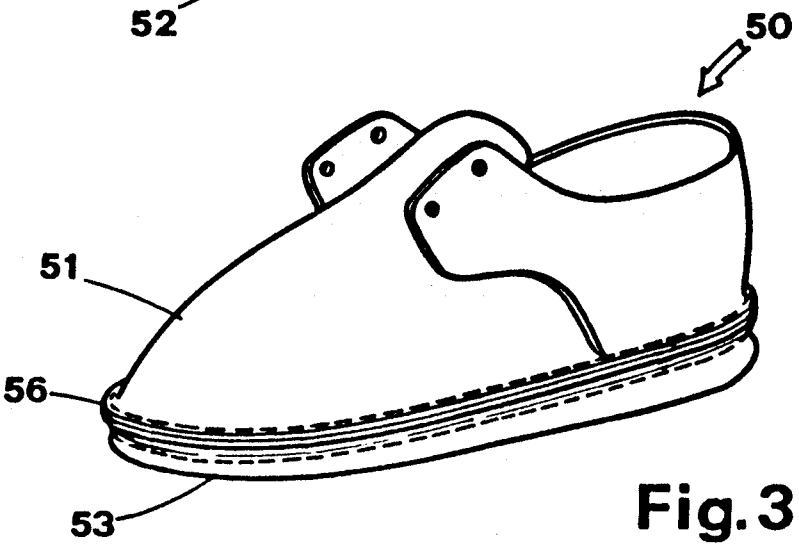
Figure 1:
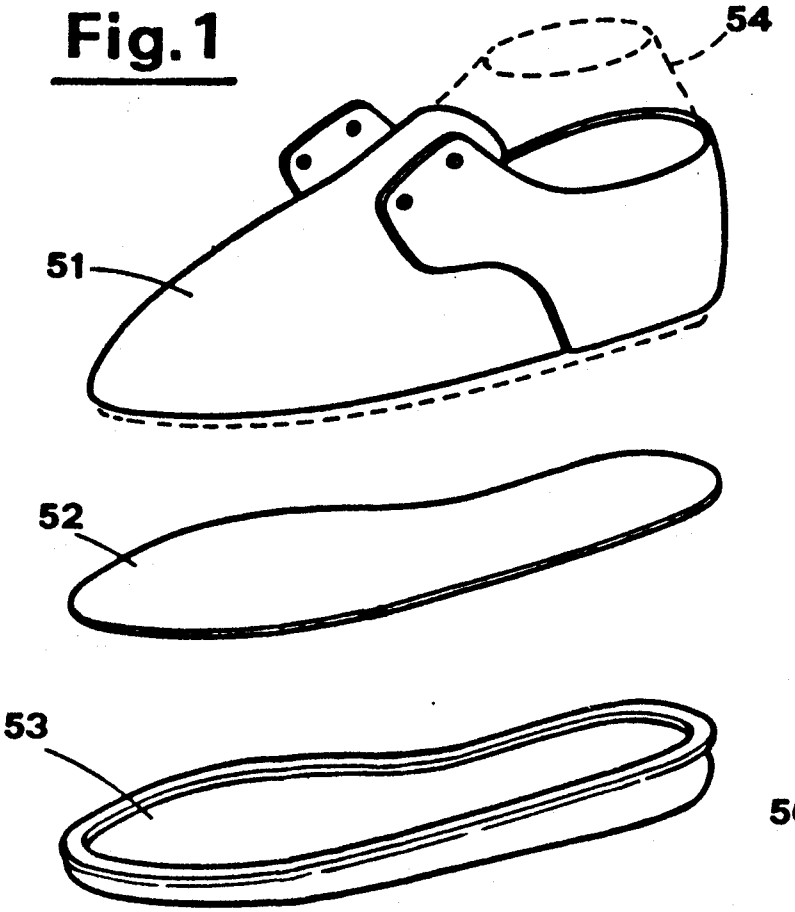
FIG. 1 shows the three main parts of a shoe.

With reference to FIGS. 1, 2 and 3, the method proposed for manufacturing a shoe 50 envisages first obtaining an upper 51, a ready-made sole 52 and a sole 53.

The second stage of the method envisages joining the lower border of the upper 51 to the corresponding surface of the external border of the ready-made sole 52.

The joining, obtained by means of gluing or a temporary stitching, can be achieved with the aid of a last 54 (shown with a dotted line in FIG. 1) inserted within the upper 51 and on the underside of which the ready-made sole 52 is placed.

Subsequently the last 54, if at all used, is extracted from the upper 51.

The next stage envisages the temporary joining of the upper/ ready-made sole assembly 55 (shown in FIG. 2) and the sole 53. This joining can be affected by gluing the surface of the ready-made sole to the sole.

The joining of the upper/ready-made sole assembly 55 and the sole 53 is completed by means of strong stitching obtained using a machine of the type described above.

In order to optimize the execution of the stitching and not to be forced to use very wide borders 56 along the perimeter of the shoe 50, the proposed method allows for placing inside the shoe, whether it be of the closed type (moccasin) or the open type (sandal), a suitable mobile striker such that it is able to move along the internal edge of the upper while maintaining its position in the stitching area, while at the same time its support does not hinder in any way the stitching operation.

In the final stage, the shoe 50 is removed from the machine and undergoes successive finishing operations.

The machine which carries out the method described so far, indicated with the number 100 in the enclosed diagrams, comprises a basic frame 9, of a known type, in which a stitching station indicated with the letter C is shown.

In the stitching station C there is a guide fork 1, with its open end towards the operator and oriented so that its parallel prongs 2*a* and 2*b*, respectively lower and upper, are in horizontal planes.

The prongs 2*a* and 2*b* have two slots 3*a*, 3*b* which allow the passage of two curved vertical opposite-facing needles, 4*a*, 4*b*, working in the same station C.

The needles 4*a*, 4*b*, of a known type, are driven by suitable devices, of a known type, contained in the machine 100, suitably synchronised and following a semicircular trajectory in an ideal vertical plane.

The unit 40 formed by the needles 4*a* and 4*b*, is furthermore subject to the action of other devices, of a known type and so not illustrated, included in the machine, which move them horizontally by a predetermined amount.

The horizontal movement of the needles 4*a* and 4*b*, affected alternately in opposite directions J1 and J2, determines the length of the stitch, and is not hindered by the prongs 2*a* and 2*b* because the slots 3*a* and 3*b* are oblong in shape.

The machine 100 also has oscillating means which support the striker mentioned in the above description of the method, which are made up of an arm 10 comprising various elements which works in the manner described below.

The end of a supporting body 13, having a substantially parallelepiped shape and a longitudinal groove 14, is hinged to the frame 9.

The support 13 can thus oscillate vertically about the end fixed to the frame 9, in opposite directions respectively upwards A and downwards D, by means of a driving means 18 and 19 linked to the support 13 by means for connecting and adjusting the angle of the same support.

In particular, to the lower part of the support 13 are removably fixed the opposite prongs of a supporting fork 15.

These prongs are attached to the support 13 by fixing means 16, which can be screws or pins, which are inserted in corresponding holes 17 made in a line along the lower lengthwise edge of the same support.

The opposite end of the fork 15 is hinged to the end of the shaft 18 of a hydraulic cylinder 19, supported by the frame 9 in an angled position.

Operation of the hydraulic cylinder 19 makes the support 13 oscillate in the above-mentioned directions A and D.

Above and below the support 13, are placed two plates 20 and 21 designed to be inserted partially and in a complementary manner in the groove 14, sliding therefore, lengthwise with respect to the support, for the whole length of the latter, in opposite directions L and V respectively away from and towards the end of the support 13 fixed to the frame 9.

The shanks of screws 22 pass through holes made in the plates 20 and 21, through the groove 14 and engage with threaded nuts 23.

Tightening the screws 22 blocks the radial movement of the plates 20 and 21, with respect to the hinging axis of the support 13.

A cylindrical body 24 is inserted into corresponding holes made in the plates 20 and 21 with its axis vertical, and is able to rotate about the same axis in opposite directions E and F.

Vertical movement of the body 24 is stopped by means of two shoulders 25 and 26 located against the corresponding surfaces of the plates 20 and 21.

The upper head of the body 24 extends by a short amount and with a reduced diameter above the upper shoulder 26, so as to provide a pin 27.

The pin 27 is inserted in the hole made on the end of a connecting-rod 28, and is fixed there by means of screws which engage with the upper shoulder 26.

As a consequence the connecting-rod can rotate together with the cylindrical body 24.

The free end of the connecting-rod 28 has on its upper part a cavity 39, within which is inserted from above the base 8 of a shaped riser 30.

The riser 30 depends on the action of means 41 to regulate its height; these means are described later.

The lower opening of the cavity 39 is closed by a plug 31 through the centre of which a threaded shank 32 passes.

The threaded shank 32 is prevented from moving vertically by support means 33 (of a known type) which fix it to the same plug 31, and it is inserted into the threaded hole of a block 34 located under the base of the riser 30.

By means of a revolving knob 35, fixed to the part of the threaded shank 32 which projects below the plug 31, it is possible to rotate the same shank.

Since the block 34 can not rotate owing to the action of the locking means 36, in this case consisting of a grub screw inserted into a hole made in the connecting-rod radial to the cavity 39, as a consequence of the rotation of the threaded shank vertical movement of the same block is obtained, and thus of the riser 30, in opposite directions up S or down T.

A grub screw 37, inserted at the end of the connecting-rod, radially to the cavity 39, prevents vertical movement and rotation of the riser 30 with respect to the connecting-rod 28.

The top of the riser 30, which is made up of a first angled section 11 followed by a second horizontal section 12, supports a disc 38 which can freely rotate on a vertical axis and has its edge towards the stitching station C.

The position of the disc 38 with respect to the guide fork 1 is regulated using the movable parts of the arm 10.

In particular moving the cylindrical body 24 along the groove 14 allows the disc 38 to be moved nearer to or farther from the guide fork 1.

Moving the support fork 15 in correspondence with other pairs of holes 17, in combination with the other horizontal movements of the body 24, and vertical movements of the riser 30, permits the inclination of the disc 38 to be regulated with respect to the guide fork 1.

Figures 4, 5, 9:
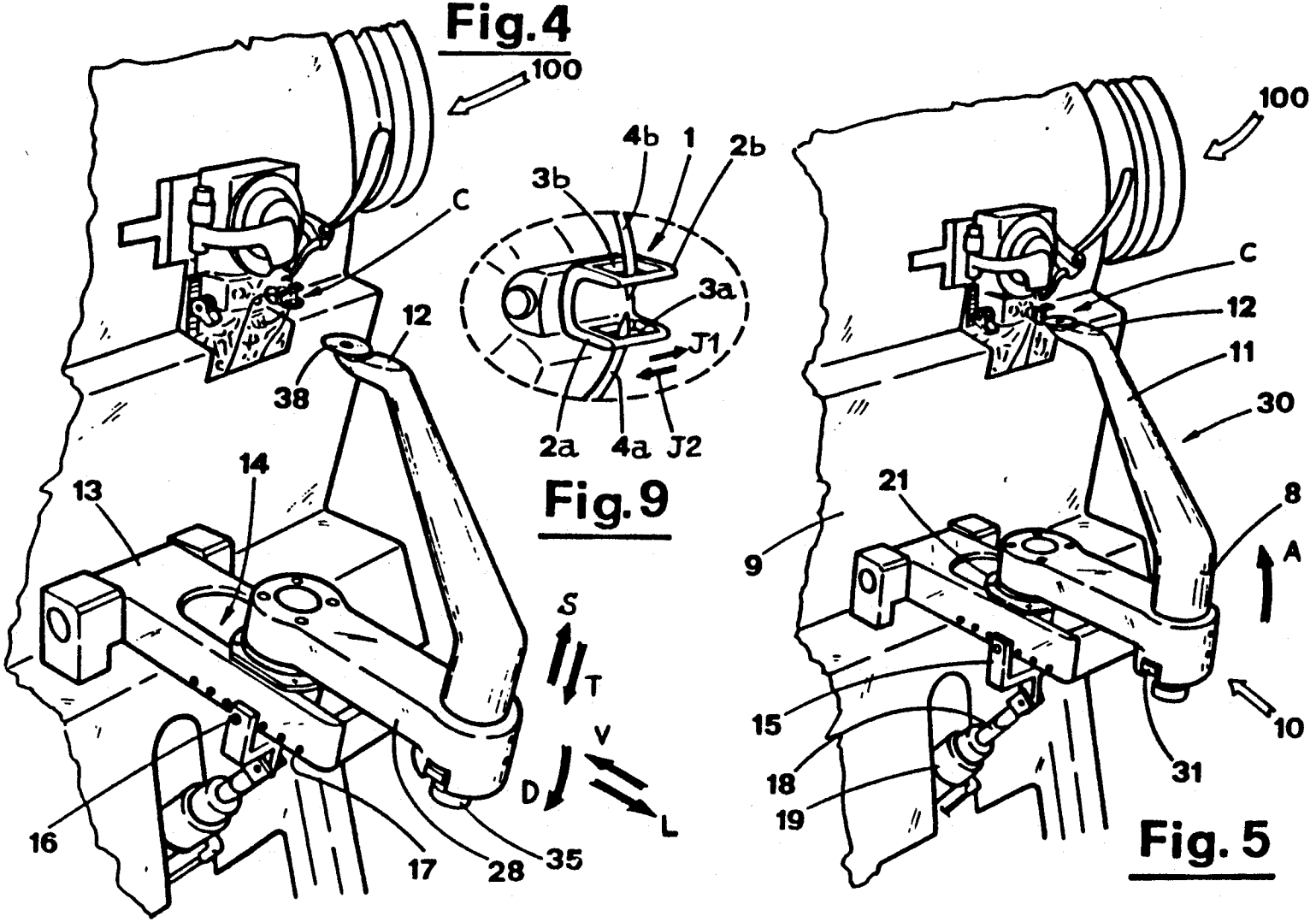
FIG. 4 and 5 are a partial perspective view of a sewing machine of the type described in the introduction, with additional devices, respectively in an idle and working position.
FIG. 9 is a detailed enlarged view of the machine concerned.

Activation of the hydraulic cylinder 19 makes the arm 10 oscillate in the directions A and D thus transferring it from one to the other of two positions respectively working P (FIG. 5) and idle N (FIG. 4).

Figure 7:
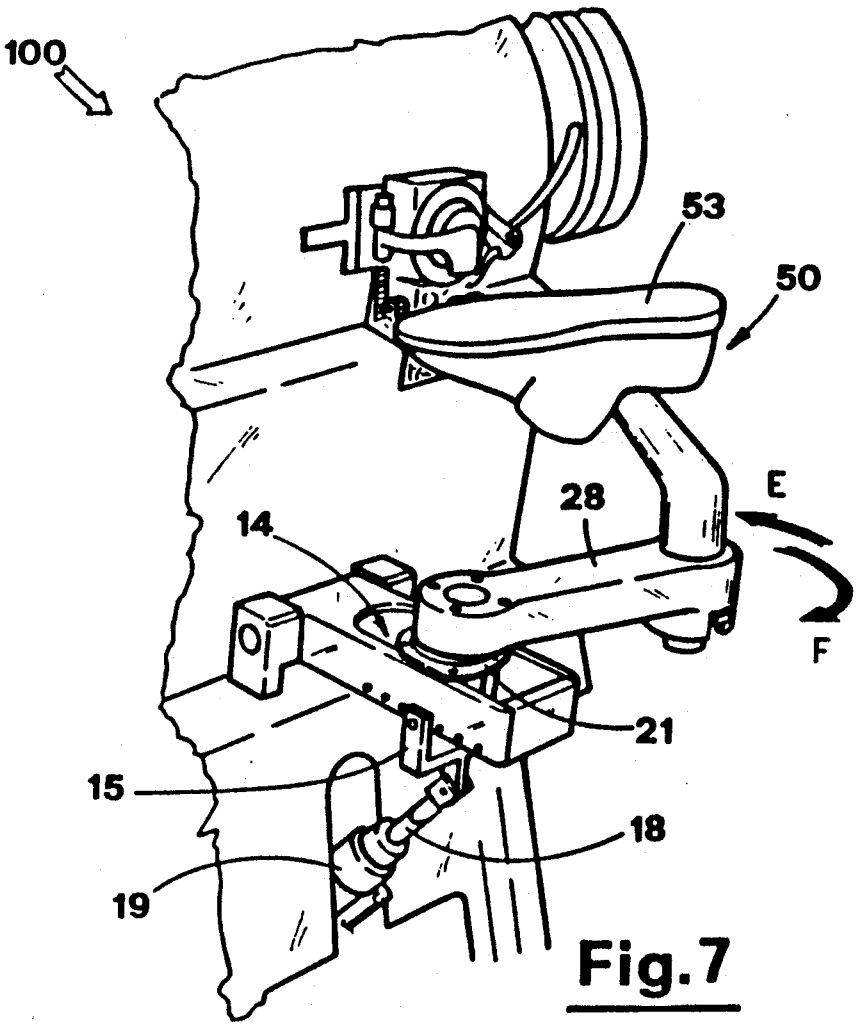
FIG. 6 and 7 show, from the same view as FIG. 5, two stages of the method for manufacturing the shoe, concerning the stitching of the upper and the sole.
Figure 6:
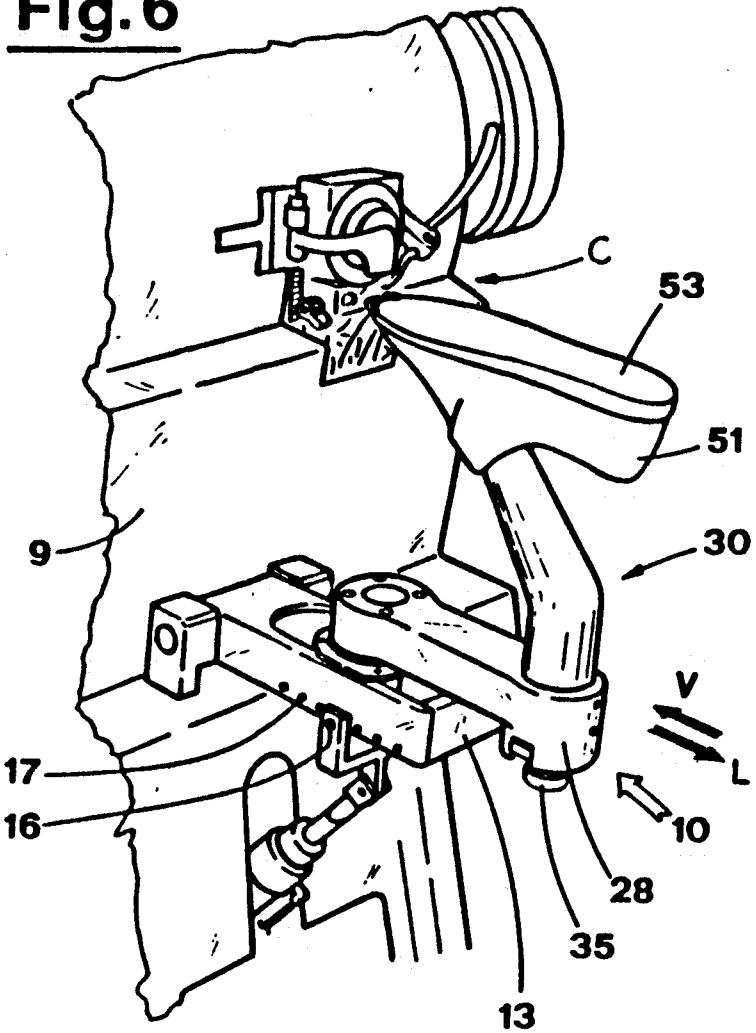
Figure 8:
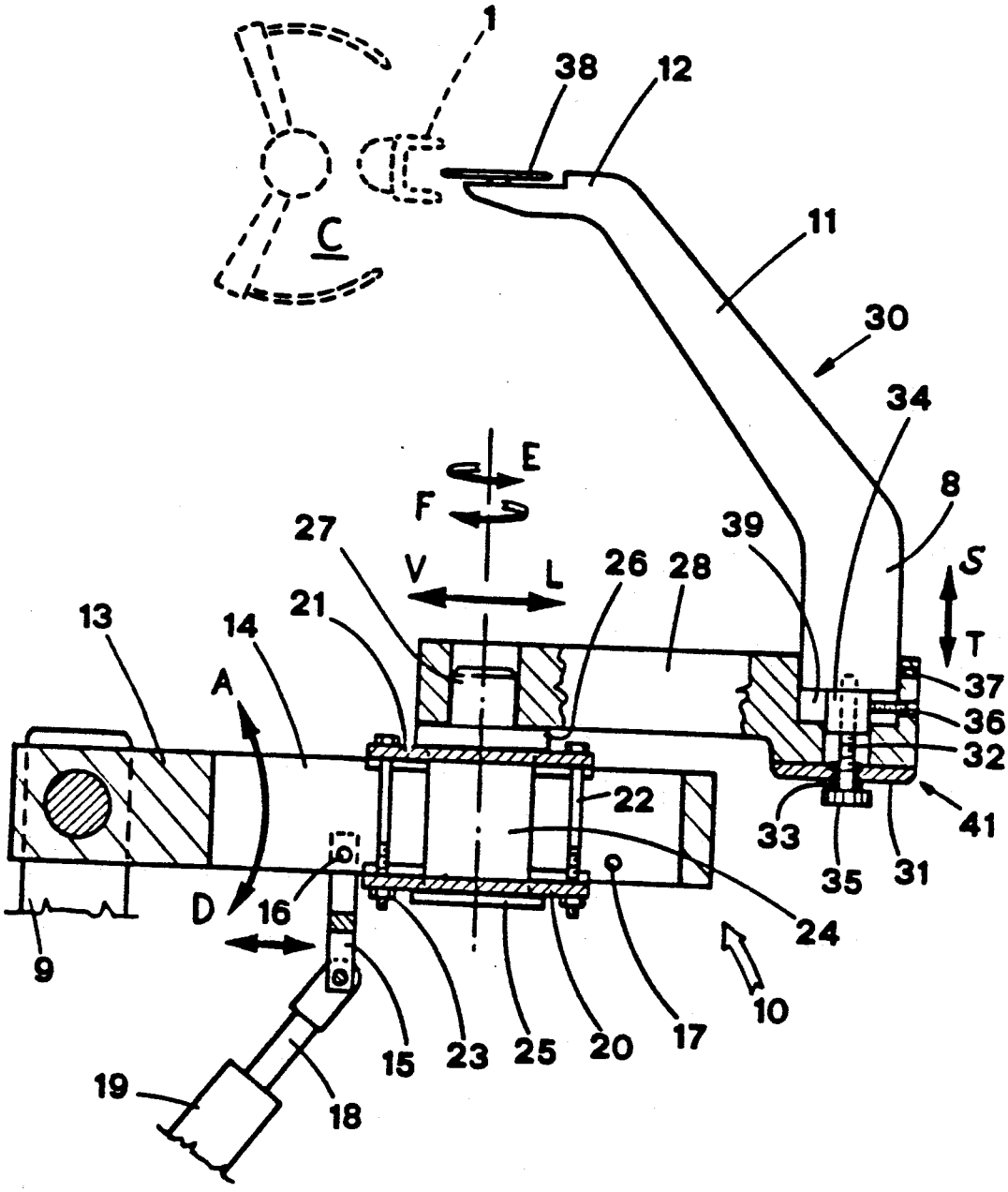
FIG. 8 is a side and partially cutaway view of the additional and modified devices of the machine in FIG. 1.

FIGS. 6 and 7 illustrate how the machine 100 works.

The shoe 50 is prepared for stitching by inserting the top part of the riser 30 inside the upper.

As already stated the sole 53 has already been joined in a temporary manner to the upper/ready-made sole assembly by gluing.

The riser 30 is inserted into the upper when the arm 10 is in the idle position N shown in FIG. 4.

Then the hydraulic cylinder 19 makes the arm 10 oscillate until it reaches the working position in FIG. 6 with the border 56, consisting of the borders of the sole and the upper, inserted between the prongs 2*a* and 2*b*. The freely rotating disc 38 is inserted between the upper 51 and the ready-made sole 52, near their previously joined border, and moves against the guide fork 1, leaving the upper placed in between, as shown in FIG. 10*a*.

Figure 10A:
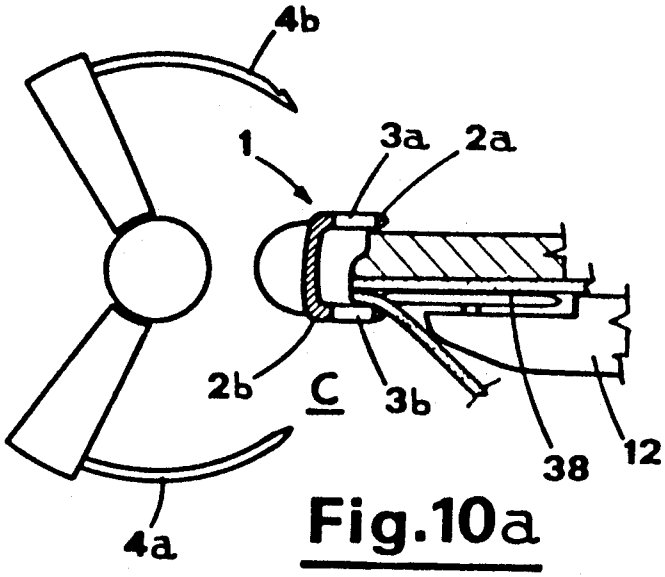
FIG. 10*a*, 10*b*, 10*c*, 10*d* is a schematic diagram of the series of operations for obtaining a stitch.
Figure 10B:
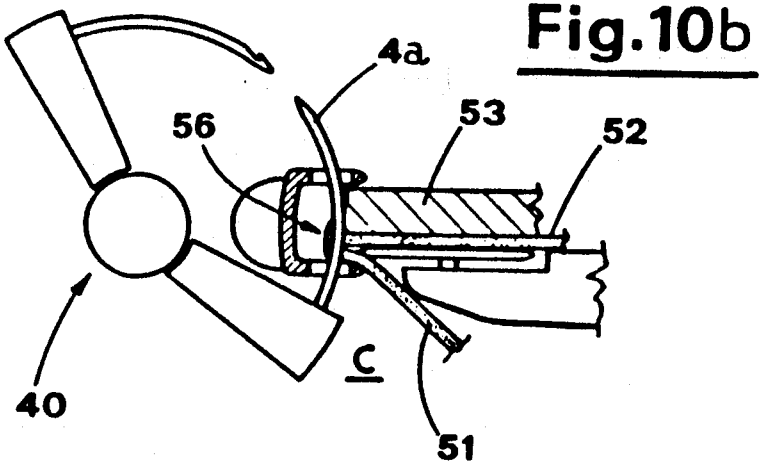
Figure 10C:
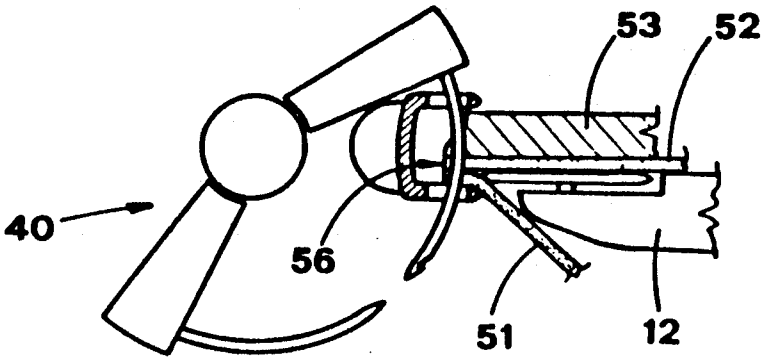
Figure 10D:
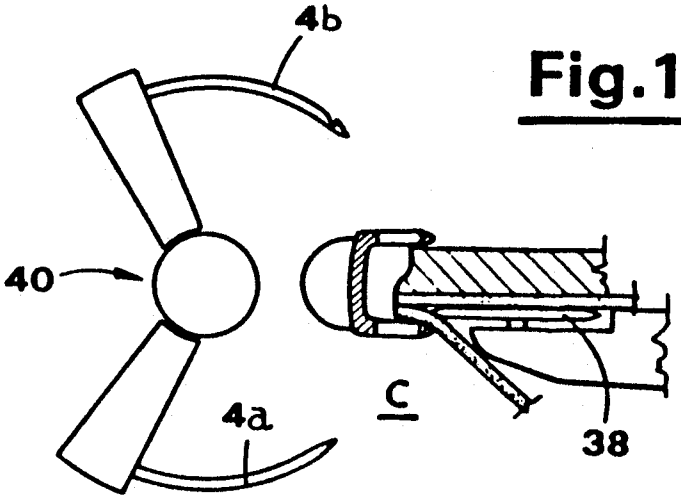

Stitching is then carried out according to the stages illustrated in FIGS. 10*a, b, c* and *d*.

The rotating disc 38 constitutes an internal striker with the function of guide for the shoe 50.

The disc is positioned closer to the stitching station C without however increasing the distance of the same from the border 56 of the shoe 50.

In this manner the border can be reduced to the minimum needed to carry out the stitching, thus avoiding negative repercussions on the total aesthetic effect of the shoe.

Rotating the shoe 50 is in no way hindered while the stitching operation proceeds along the slide of the shoe, as illustrated in FIG. 7. This is because the arm 10 can follow the rotation of the shoe, rotating around the axis of the rotating pin 27.

It should be noted here that the axis of rotation of the disc 38 coincides with the axis of rotation of the body 24, so that even when the arm rotates, the position of the disc 38 with respect to the guide fork 1 is substantially the same.

In this way the different angles of the connecting-rod 28 with respect to the longitudinal axis of the support 13 allow the disc always to be correctly positioned without the riser 30 hindering the movements of the shoe.

Thus the operator can do the stitching safely and more rapidly, obtaining all the while the best possible results irrespective of his of her level of skill.

Obviously for the adjustment of the height of the riser 30 a different kind of device can be envisaged, designed however to operate in the cavity 39.

While the invention has been described in terms of what is presently considered to be the most practical and preferred embodiments, it is to be understood that the invention has not to be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A machine including a main frame, for stitching a sole to an upper/ready made sole assembly at a stitching station, said station comprising:

a guide fork having an upper prong and a lower prong, said prongs projecting in a first direction toward a position where an operator would be located in using said machine, said prongs being parallel to each other and including a respective slot in each said prong;

an upper needle and a lower needle, said needles being curved and opposite facing, said needles being mounted at a right angle to said first direction for passage through said slots in respective semi-circular trajectories and with transverse movements in opposite directions to affect stitching;

a striker for sliding along an inside part of said sole assembly during stitching, said striker having a first axis and holding a peripheral edge of said sole assembly against said guide fork;

support means for holding said striker in a position opposing said guide fork for stitching said sole assembly with said needles, said support means including:

(a) pivotable means connected to said striker for adjustably orienting said first axis of said striker relative to said first direction of said prongs, (b) translational means connected to said striker for moving said striker toward and away from said guide fork, and (c) rotational means connected to said striker for aligning said peripheral edge of said sole assembly during movement of said sole assembly by said operator in continuous motion relative to said guide fork.

2. A machine as in claim 1, wherein:

said pivotable means include a support of extended length hinged to said machine frame along an axis perpendicular to said needle trajectories, drive means connected to said support for pivoting said support at said hinged connection to the frame, and linking and adjustment means positioned intermediate said drive means and said support;

said translational means include a body having an axis and mounted for sliding along said support in opposite lengthwise directions, said body being rotatable about said axis in opposite directions, and means for blocking said lengthwise sliding of said body, said body having an upper head;

said rotational means include a connecting-rod fixed at one end to said upper head of said body and extended radially therefrom, and connecting-rod being subject to rotation with said body; and said rotational means further including a riser having a base rotatably inserted into a cavity at the other end of said connecting-rod, and having a first angled section followed by a second section parallel to said connecting rod, and means for adjusting the distance of said second section from said connecting rod, said adjusting means being located in correspondence with said cavity, said second section supporting said striker for rotation about said first striker axis.

3. A machine according to claim 2, wherein said driving means include a hydraulic cylinder having an extendable and retractable shaft, said cylinder being joined to the frame of said machine, and said shaft being hinged to said linking and adjustment means of said support, the angle of said support relative to said frame being adjustable by movement of said shaft.

4. A machine according to claim 2, wherein said linking and adjustment means of the angle of said support, includes a support fork fixed to said support by fixing means for engaging corresponding holes spaced lengthwise along said support, the opposite end of said fork being hinged to said drive means.

5. A machine, according to claim 4, wherein said fixing means include a pair of screws which engage with corresponding holes.

6. A machine according to claim 2, wherein said means for adjusting the distance of said riser comprise a plug which closes said cavity below and rotatably supports a threaded shank which is maintained coaxial with said cavity by means of support means;

a block inserted into the cavity and having a threaded hole which engages with said threaded shank;

locking means for blocking the axial rotation of said block;

a knob fixed to the outside end of said shaft for the axial rotation of said shank and the consequent vertical movement of said block in opposite directions respectively up and down, said block acting on the base of said riser.

7. A machine according to claim 6, wherein said locking means which block the rotation of said block include a grub screw inserted into a threaded hole of said block made in alignment with a corresponding hole of said connecting-rod, said screw extending radially with respect to said cavity.

8. A machine according to claim 2, wherein said body is of cylindrical shape, is inserted into a groove made lengthwise along said support for sliding therealong, said body having opposite heads inserted into corresponding holes made on two plates, said plates comprising said means for blocking lengthwise movement of said body with respect to the support, said plates being partially and complimentarily inserted into the groove, respectively above and below said support, and subject to longitudinal movement in opposite directions respectively away from and towards said frame;

a number of screw, the shanks of said screws being inserted into holes made in said plates, and also into said groove, said screws engaging with threaded nuts, and tightening of said nuts preventing movement of said plates with respect to the hinged end of the support by clamping said plates to said support.

9. A machine according to claim 8, wherein said cylindrical body is attached to said plates by means of two shoulders situated externally with respect to the two plates and against the corresponding surfaces of said plates.

10. A machine according to claim 2, wherein said body extends upwardly with reduced diameter to form a pin inserted into a suitable hole made in the corresponding end of said connecting-rod, said connecting-rod being fixed to said body by means of a series of screws which engage with said body.

11. A machine according to claim 2, wherein said striker is a disc horizontally and rotatably supported by said support means.

12. A machine according to claim 2, further comprising a grub screw, said riser being prevented from rotating with respect to said connecting-rod by means of said grub screw being inserted into a threaded hole made in said riser to align with a corresponding hole of said connecting-rod, said screw extending radially with respect to said cavity.

* * * * *